US009230502B2

(12) United States Patent
Watanabe

(10) Patent No.: US 9,230,502 B2
(45) Date of Patent: Jan. 5, 2016

(54) DISPLAY DEVICE HAVING BLOCKING CIRCUIT FOR EXTRACTING START PULSE FROM SIGNAL

(71) Applicant: Semiconductor Energy Laboratory Co., Ltd., Kanagawa-ken (JP)

(72) Inventor: Kazunori Watanabe, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 388 days.

(21) Appl. No.: 13/761,461

(22) Filed: Feb. 7, 2013

(65) Prior Publication Data

US 2013/0207945 A1 Aug. 15, 2013

(30) Foreign Application Priority Data

Feb. 13, 2012 (JP) ..... 2012-028058

(51) Int. Cl.

| | |
|---|---|
| ***G09G 5/00*** | (2006.01) |
| ***G09G 5/18*** | (2006.01) |
| *G09G 3/32* | (2006.01) |

(52) U.S. Cl.

CPC .. *G09G 5/00* (2013.01); *G09G 5/18* (2013.01); *G09G 3/3225* (2013.01); *G09G 2300/0426* (2013.01); *G09G 2320/0223* (2013.01); *G09G 2330/02* (2013.01); *G09G 2370/08* (2013.01)

(58) Field of Classification Search

None

See application file for complete search history.

(56) References Cited

U.S. PATENT DOCUMENTS

| | | | | |
|---|---|---|---|---|
| 6,388,652 | B1 | 5/2002 | Yamazaki et al. | |
| 6,778,164 | B2 | 8/2004 | Yamazaki et al. | |
| 6,956,324 | B2 | 10/2005 | Yamazaki | |
| 7,256,776 | B2 | 8/2007 | Yamazaki et al. | |
| 7,750,899 | B2 | 7/2010 | Miyata et al. | |
| 7,830,370 | B2 | 11/2010 | Yamazaki et al. | |
| 7,978,190 | B2 | 7/2011 | Yamazaki et al. | |
| 2006/0001927 | A1* | 1/2006 | Murade | G02F 1/1345 358/518 |
| 2007/0200810 | A1* | 8/2007 | Kawata | G09G 3/3611 345/89 |
| 2010/0309173 | A1* | 12/2010 | Matsuda | G09G 3/3674 345/204 |
| 2010/0315406 | A1* | 12/2010 | Nose | G09G 3/20 345/212 |
| 2011/0032235 | A1* | 2/2011 | Nose | G09G 3/3611 345/211 |
| 2011/0181556 | A1* | 7/2011 | Sakai | G09G 3/3685 345/204 |
| 2013/0162609 | A1 | 6/2013 | Miyake et al. | |

FOREIGN PATENT DOCUMENTS

| | | |
|---|---|---|
| JP | 10-171413 | 6/1998 |
| JP | 2011-237644 | 11/2011 |
| JP | 2011-237644 A | 11/2011 |
| JP | 2011-238067 | 11/2011 |

* cited by examiner

*Primary Examiner* — Ryan A Lubit

(74) *Attorney, Agent, or Firm* — Husch Blackwell LLP

(57) ABSTRACT

A display device with fewer terminals. The display device includes a timing signal generating circuit which outputs an output signal based on a clock signal, in which one signal line serves as both a signal line to which a start pulse signal that drives the timing signal generating circuit is input and a signal line to which an image signal is input. Further, a blocking circuit which outputs a start pulse to the timing signal generating circuit but does not output the image signal is provided between the signal line and the timing signal generating circuit.

9 Claims, 8 Drawing Sheets

DISPLAY DEVICE HAVING BLOCKING CIRCUIT FOR EXTRACTING START PULSE FROM SIGNAL

BACKGROUND OF THE INVENTION

1. Field of the Invention

The present invention relates to a display device.

2. Description of the Related Art

To drive a display device, power supply, a clock signal, and various synchronizing signals for synchronizing operations of driver circuits in the display device are necessary in addition to many image signals.

For example, Patent Document 1 discloses a liquid crystal display device having a timing generator, to which synchronizing signals, i.e., a master clock, a horizontal synchronizing signal, and a vertical synchronizing signal, are input and which supplies a signal to an LCD driver circuit on the basis of the synchronizing signals.

REFERENCE

Patent Document 1: Japanese Published Patent Application No. H10-171413

SUMMARY OF THE INVENTION

Many wires for supplying the above-mentioned signals are required between a display device and a device which supplies signals for driving the display device (e.g., the main body of an electronic device). As a result, the wires occupy a volume in part of the display device, which might limit the flexibility in design, for example, the shape of the main body of the electronic device and the position or method of the layout of the display device inside the electronic device.

Thus, in a display device, with fewer terminals to which signals from the outside are supplied, the number of wires between the display device and a device which supplies the signals to the display device can be reduced, giving greater design flexibility.

The present invention has been made in view of the foregoing technical background. An object of one embodiment of the present invention is thus to reduce terminals in a display device.

To achieve the above object, with the focus on a signal line through which a signal is input to a timing generator (hereinafter, referred to as a timing signal generating circuit), an idea that one signal line serves as both this signal line and another signal line has been obtained.

The timing signal generating circuit is a circuit configured to generate timing signals for synchronizing operations of driver circuits (e.g., a scan line driver circuit and a signal line driver circuit) in a display device on the basis of a clock signal which is input thereto and to output the timing signals. To the timing signal generating circuit, a start pulse signal for controlling the start of an operation of the timing signal generating circuit needs to be input, in addition to the clock signal.

One embodiment of the present invention includes a timing signal generating circuit which outputs a timing signal based on a clock signal, in which one signal line serves as both a signal line to which a start pulse signal that drives the timing signal generating circuit is input and a signal line to which an image signal is input. Further, a blocking circuit which outputs a start pulse to the timing signal generating circuit and outputs no image signal is provided between the signal line and the timing signal generating circuit.

Owing to the signal line thus serving as both the signal line to which a start pulse signal is input and the signal line to which an image signal is input, an external input terminal for inputting the start pulse signal which has been necessary in a conventional structure can be omitted. Thus, a display device with fewer terminals can be achieved.

A display device of one embodiment of the present invention includes: a display portion including a plurality of pixels; a scan line driver circuit electrically connected to the display portion; a signal line driver circuit electrically connected to the display portion; a timing signal generating circuit configured to output timing signals to each of the scan line driver circuit and the signal line driver circuit; a first external input terminal to which an image signal including a start pulse signal configured to drive the timing signal generating circuit is input and which is electrically connected to the signal line driver circuit; a second external input terminal to which a clock signal is input and which is electrically connected to the timing signal generating circuit; and a blocking circuit electrically connected to the first external input terminal and configured to extract the start pulse signal from the first signal and output the start pulse signal to the timing signal generating circuit.

A display device of another embodiment of the present invention includes: a display portion including a plurality of pixels; a scan line driver circuit electrically connected to the display portion; a signal line driver circuit electrically connected to the display portion; a serial-parallel conversion circuit configured to convert a first image signal that is a serial signal into a second image signal that is a parallel signal and output the second image signal to the signal line driver circuit; a timing signal generating circuit configured to output a timing signal to each of the scan line driver circuit, the signal line driver circuit, and the serial-parallel conversion circuit; a first external input terminal to which a first image signal including a start pulse signal configured to drive the timing signal generating circuit is input and which is electrically connected to the serial-parallel conversion circuit; a second external input terminal to which a clock signal is input and which is electrically connected to the timing signal generating circuit; and a blocking circuit electrically connected to the first external input terminal and configured to extract the start pulse signal from the first signal and output the start pulse signal to the timing signal generating circuit.

Thus, in the display device without the external input terminal to which a start pulse signal is input, the serial-parallel conversion circuit is provided and the serial signal is used as the image signal, so that the number of external input terminals to which the image signal is input can be reduced to one. That is, the start pulse signal and the image signal that is a serial signal are input to the external input terminal to which the image signal is to be input. Such a structure enables a display device with extremely fewer terminals to be achieved.

For example, when three power supply potentials (a high power supply potential, a low power supply potential, and a ground potential) are used as the power supply potentials for driving the display device, the number of external input terminals in the display device can be reduced to five. Here, signals and power supply potentials to be input to the five external input terminals are the following: a high power supply potential, a low power supply potential, a ground potential, a clock signal, and a signal into which a start pulse signal and an image signal are integrated.

The blocking circuit in either of the above display device preferably includes a first switch and a second switch and has the following structure: one terminal of the first switch is electrically connected to the first external input terminal; the other terminal of the first switch is electrically connected to the timing signal generating circuit; a ground potential is input to one terminal of the second switch; the other terminal of the second switch is electrically connected to the timing signal generating circuit; and when the start pulse signal is input, the first switch is turned off and the second switch is turned on.

Such a blocking circuit enables the start pulse signal input thereto to be output to the timing signal generating circuit, and after the start pulse signal is input, the blocking circuit enables the ground potential to be continuously output to the timing signal generating circuit without fail. Consequently, input of noise, which is due to the image signal input to the blocking circuit, to the timing signal generating circuit is suppressed and the timing signal generating circuit can operate reliably without malfunctioning.

In addition to any of the above configurations, the display device preferably includes a third external input terminal to which a high power supply potential is input, a fourth external input terminal to which a low power supply potential is input, and a fifth external input terminal to which a ground potential is input and has the following structure: each of the pixels includes a light-emitting element including a layer including a light-emitting organic compound between a first electrode and a second electrode; a potential lower than the high power supply potential and higher than the low power supply potential is applied to the first electrode in accordance with the signal input from the first external input terminal; and the high power supply potential or the low power supply potential is applied to the second electrode.

Such use of an organic electroluminescent (EL) element in the above-described display device with fewer terminals as described above enables a self-luminous display device with fewer terminals to be achieved.

Particularly in combination with a self-luminous organic EL element, for example, a backlight indispensable for a liquid crystal display device is unnecessary and a wire for driving the backlight is not required. Such use of a self-luminous organic EL element is preferred, in which case the number of wires connected to the display device can be minimized.

For example, since such a display device with fewer terminals lead to a reduction in the number of wires for connection to the display device, the display device can be applied to display portions of portable electronic devices such as cellular phones and tablet terminals with greater design flexibility. In addition, the display device can be suitably applied to electronic devices, such as head mounted displays, whose housing (frame, for example) including wires are expected to be thinner and lighter.

In this specification, the display device includes any of the following modules in its category: a module in which a connector such as a flexible printed, circuit (FPC) or a tape carrier package (TCP) is attached to a display device; a module having a TCP provided with a printed wire board at the end thereof; and a module having an integrated circuit (IC) directly mounted over a substrate over which a pixel is formed by a chip on glass (COG) method.

In this specification, any device that can function using semiconductor characteristics is also referred to as a semiconductor device. Hence, a display device utilizing semiconductor characteristics is also one mode of a semiconductor device. In addition, an electro-optical device, a semiconductor circuit, and an electronic device are also modes of the semiconductor device.

In accordance with the present invention, a display device with fewer terminals can be provided.

DETAILED DESCRIPTION OF THE INVENTION

Figure 1A:
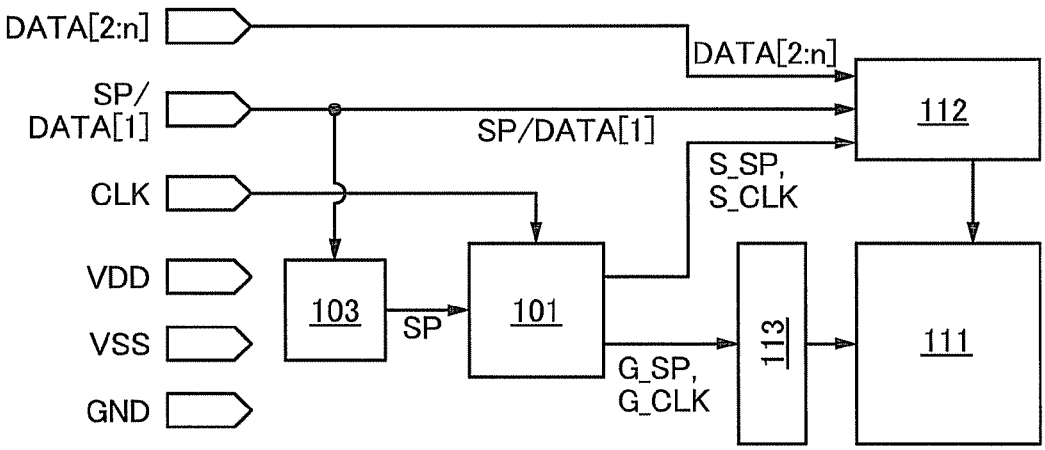
FIGS. 1A and 1B illustrate a configuration example of a display device of one embodiment of the present invention and a timing chart related to an operation of the display device.

Embodiments will be described in detail with reference to the accompanying drawings. Note that the invention is not limited to the following description, and it will be easily understood by those skilled in the art that various changes and modifications can be made without departing from the spirit and scope of the invention. Therefore, the invention should not be construed as being limited to the description in the following embodiments. Note that in the structures of the invention described below, the same portions or portions having similar functions are denoted by the same reference numerals in different drawings, and description of such portions is not repeated.

Note that in each drawing of this specification, the size, the thickness, or the region of each component is exaggerated for clarity in some cases. Accordingly, the present invention is not always limited to the scale.

A transistor is a kind of semiconductor elements and can achieve amplification of a current or a voltage, switching operation for controlling conduction or non-conduction, or the like. A transistor in this specification includes an insulated-gate field effect transistor (IGFET) and a thin film transistor (TFT).

Functions of a "source" and a "drain" are sometimes replaced with each other when a transistor of opposite polarity is used or when the direction of a current flowing is changed in circuit operation, for example. Therefore in this specification, the terms "source" and "drain" can be used to denote the drain and the source, respectively.

In this specification and the like, one of a source and a drain of a transistor is referred to as a "first electrode" and the other of the source and the drain is referred to as a "second electrode" in some cases. Note that a gate is also referred to as a "gate" or a "gate electrode".

Note that in this specification and the like, two electrodes of a diode are referred to as a "first electrode" and a "second electrode" or a "first terminal" and a "second terminal" in some cases. Here, a direction in which a current flows from the first electrode to the second electrode is a forward direction of the diode and its opposite direction is an opposite direction of the diode. In addition, one of the electrodes is simply referred to as a "terminal", "one end", "one", or the like in some cases.

Note that in this specification and the like, the term "electrically connected" includes the case where components are connected through an object having any electric function. There is no particular limitation on the object having any electric function as long as electric signals can be transmitted and received between components that are connected through the object. Examples of the "object having any electric action" include a switching element such as a transistor, a resistor, a coil, a capacitor, and an element with a variety of functions in addition to an electrode and a wire.

Note that a node in this specification and the like means an element (e.g., a wire) which enables electrical connection between elements included in a circuit. Therefore, a "node to which A is connected" is a wire which is electrically connected to A and can be regarded as having the same potential as A. Note that even when one or more elements which enable electrical connection (e.g., switches, transistors, capacitors, inductors, resistors, or diodes) are inserted in a portion of the wire, the wire can be regarded as the "node to which A is connected" as long as it has the same potential as A.

(Embodiment 1)

In this embodiment, a configuration example of a display device of one embodiment of the present invention is described with reference to drawings.

[Configuration Example of Display Device]

A display device exemplified in this embodiment is schematically illustrated in FIG. 1A.

Figure 1B:
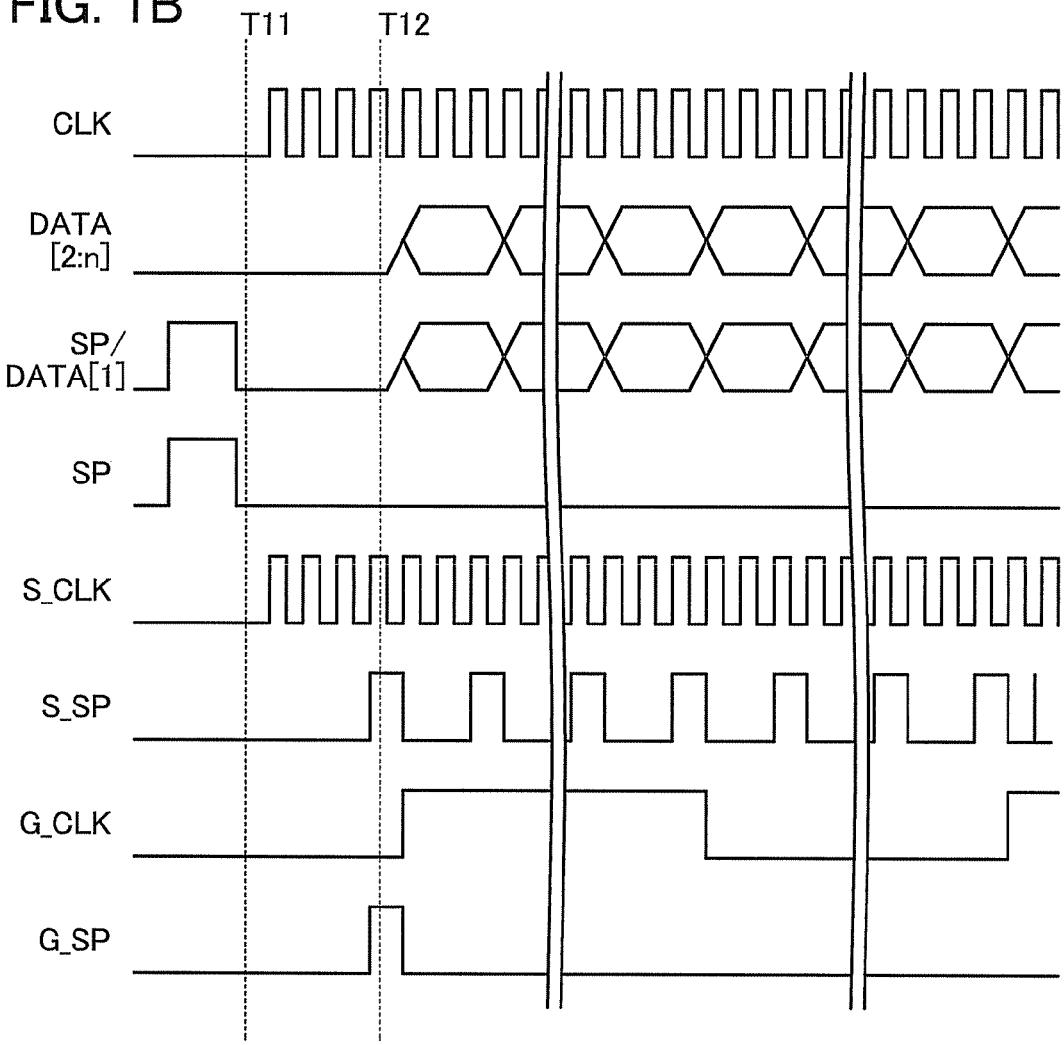

The display device illustrated in FIGS. 1A and 1B includes a display portion 111, a signal line driver circuit 112, a scan line driver circuit 113, a timing signal generating circuit 101, and a blocking circuit 103.

To the display device, a clock signal CLK, a high power supply potential VDD, a low power supply potential VSS, and a ground potential GND are input. Further, a plurality of image signals (DATA[1] to DATA[n]) is input to the display device. At least one (here, DATA[1]) of the plurality of image signals is integrated with a start pulse signal SP and input as a signal SP/DATA[1] to the display device. The rest of the image signals (DATA[2] to DATA[n] (hereinafter, collectively referred to as DATA[2:n])) are input through a plurality of different external input terminals.

In the case where a plurality of image signals is thus input through a plurality of external input terminals, at least one of the image signals is a signal including a start pulse signal.

Note that as exemplified in a later embodiment, in the case where a serial signal is used as the image signal, the image signals input to the display device can be integrated into one signal, so that only a signal SP/DATA, into which a start pulse SP and an image signal DATA are integrated, is input to the display device.

The plurality of image signals DATA[2:n] is each input to the signal line driver circuit 112. The signal SP/DATA[1] is split into two and they are input to the blocking circuit 103 and the signal line driver circuit 112. The clock signal CLK is input to the timing signal generating circuit 101. The high power supply potential VDD, the low power supply potential VSS, and the ground potential GND are supplied to each circuit as needed.

The display portion 111 includes a plurality of signal lines through which the image signals from the signal line driver circuit 112 are input, a plurality of scan lines to which selection signals from the scan line driver circuit 113 are input, and a plurality of pixels each of which is electrically connected to one of the signal lines and one of the scan lines and has a display element.

Examples of the display element included in each pixel are light-emitting elements such as an organic EL element, an inorganic EL element, and a light emitting diode (LED) element, a liquid crystal element, an electrophoretic element, and the like. Further, the display portion 111 may be a passive matrix display portion or an active matrix display portion whose pixel includes at least one selection transistor.

The signal line driver circuit 112 outputs the image signals successively to the signal lines in the display portion 111 in accordance with a timing signal input from the timing signal generating circuit 101 described later. Further, in accordance with a timing signal, the scan line driver circuit 113 outputs the selection signals successively to the scan lines in the display portion 111.

The timing signal generating circuit 101 generates timing signals for synchronizing driving of the signal line driver circuit 112 and driving of the scan line driver circuit 113 on the basis of the clock signal CLK, and transmits the timing signals to the signal line driver circuit 112 and the scan line driver circuit 113.

Examples of the timing signals generated by the timing signal generating circuit 101 are a start pulse signal S_SP and a clock signal S_CLK which are output to the signal line driver circuit 112, a start pulse signal G_SP and a clock signal G_CLK which are output to the scan line driver circuit 113, and the like. Hereinafter, such signals output from the timing signal generating circuit 101 may be collectively referred to as a timing signal.

Further, the timing signal generating circuit 101 starts its operation in accordance with the start pulse signal SP input from the blocking circuit 103.

The blocking circuit 103 extracts only the start pulse signal SP from the signal SP/DATA and transmits the start pulse signal SP to the timing signal generating circuit 101. The blocking circuit 103 also has such a function of blocking input of the image signal DATA, which is included in the signal SP/DATA, to the timing signal generating circuit 101.

An example of a timing chart of the signals in the display device is shown in FIG. 1B.

In FIG. 1B, time T11 represents the time at which the clock signal CLK starts to oscillate and time T12 represents the time at which the image signal DATA[1:n] starts to be input.

The signal SP/DATA[1] includes the start pulse signal SP which is a pulse signal rising before the time T11 and the image signal DATA[1] which starts to be input at the time T12.

The blocking circuit 103 extracts only the start pulse signal SP from the input signal SP/DATA[1] and outputs the start pulse signal SP to the timing signal generating circuit 101. Further, the blocking circuit 103 blocks output of the image signal DATA[1], which is input at and after the time T12, to the timing signal generating circuit 101.

The timing signal generating circuit 101 starts to be driven by the start pulse signal SP input thereto and transitions to the standby state. Then, after the clock signal CLK is input at the time T11, the timing signals are generated on the basis of the clock signal CLK and output to the signal line driver circuit 112 and the scan line driver circuit 113.

FIG. 1B schematically shows, as examples of the timing signals output from the timing signal generating circuit 101, the start pulse signal S_SP and the clock signal S_CLK which are output to the signal line driver circuit 112, and the start pulse signal G_SP and the clock signal G_CLK which are output to the scan line driver circuit 113. Note that in FIG. 1B, the cycle of the clock signal or the like is longer than the actual cycle for clarity.

With such a configuration, a terminal through which an image signal DATA is input can be omitted because the terminal through which the start pulse signal SP for starting the driving of the timing signal generating circuit 101 is input also serves as the terminal to which the image signal DATA is input. Consequently, a display device with fewer terminals can be achieved.

[Configuration Example of Blocking Circuit]

A configuration example of the blocking circuit 103 is described below.

Figure 2A:
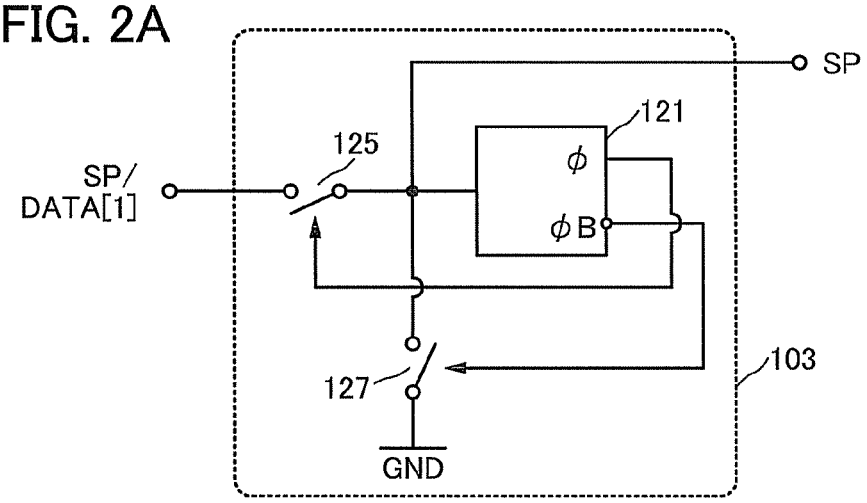
FIGS. 2A and 2B illustrate configuration examples of a blocking circuit in a display device of one embodiment of the present invention.

The blocking circuit 103 exemplified in this configuration example is schematically illustrated in FIG. 2A.

The blocking circuit 103 includes two switches (a switch 125 and a switch 127) and a switch control circuit 121 which controls on/off of the two switches.

The signal SP/DATA[1] is input to one terminal of the switch 125 and the other terminal of the switch 125 is electrically connected to an input portion of the switch control circuit 121 and to an output portion of the blocking circuit 103. The ground potential GND is input to one terminal of the switch 127 and the other terminal of the switch 127 is electrically connected to the output portion of the blocking circuit 103. The switch control circuit 121 outputs a control signal $\phi$ to the switch 125 and outputs an inversion control signal $\phi$B, whose phase is inverted from that of the control signal $\phi$, to the switch 127.

An operation of the blocking circuit 103 is described below. Until the start pulse signal SP is input, the switch 125 is kept on and the switch 127 is kept off.

When input to the blocking circuit 103, the start pulse signal SP is output from the output portion of the blocking circuit 103 through the switch 125.

In accordance with the start pulse signal SP input through the switch 125, the switch control circuit 121 inverses the phases of the two control signals that are to be output from the switch control circuit 121. Consequently, the switch 125 is turned off and the switch 127 is turned on. Hence, after that, the ground potential is constantly output to the output portion of the blocking circuit 103 through the switch 127.

With such a configuration, the blocking circuit 103 can extract only the start pulse signal SP from the input signal SP/DATA[1] to output the start pulse signal SP and can block the image signal DATA[1].

A more specific configuration example of the blocking circuit 103 is now described.

Figure 2B:
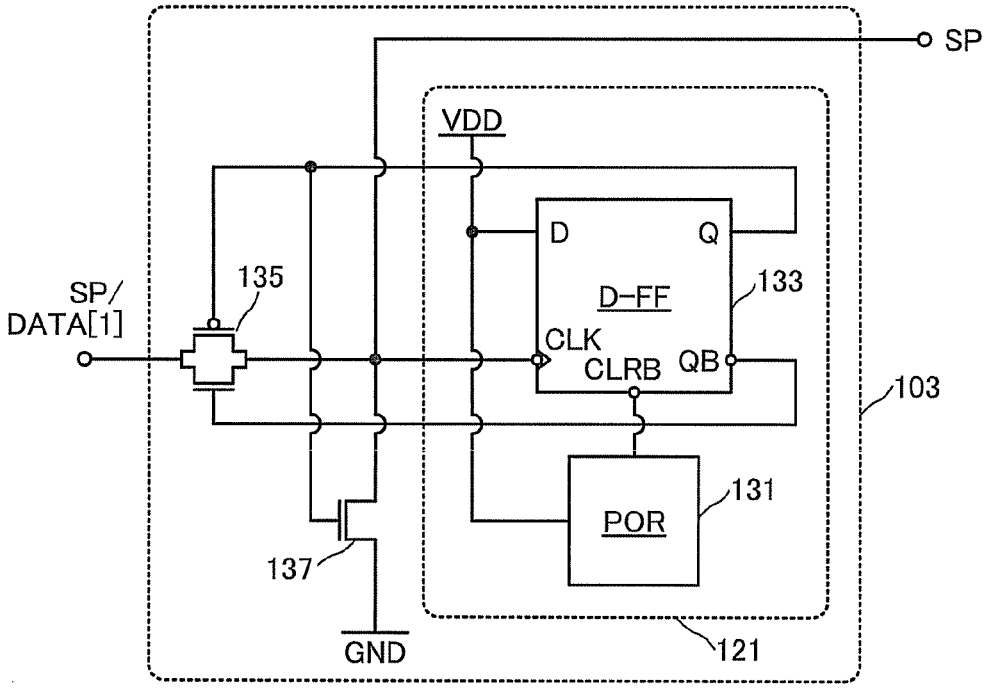

The blocking circuit 103 illustrated in FIG. 2B has a configuration in FIG. 2A and particularly employs an analog switch 135 as the switch 125, a transistor 137 as the switch 127, and a flip-flop circuit 133 and a power-on reset (POR) circuit 131 as the switch control circuit 121

In this configuration example, a negative edge-triggered delay flip-flop (D-FF) is used as the flip-flop circuit 133. The flip-flop circuit 133 has an input terminal D, a clock input terminal CLK, a clear input terminal CLRB, an output terminal Q, and an inverse output terminal QB.

The flip-flop circuit 133 operates (is placed into the active state) when a high-level potential is input to the clear input terminal CLRB. In contrast, when a low-level potential is input, its output is initialized (placed into the inactive state), so that a low-level potential is output to the output terminal Q regardless of the signals input to the input terminal D and the clock input terminal CLK.

The POR circuit 131 is a circuit that outputs a reset signal when powered.

As the POR circuit 131, a known POR circuit can be used. For example, an RC circuit can be applied so as to form a simple configuration illustrated in FIG. 3.

Figure 3:
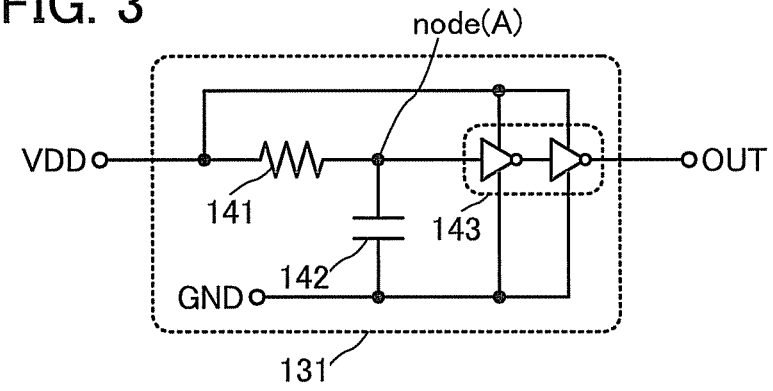
FIG. 3 illustrates a configuration example of a POR circuit in a display device of one embodiment of the present invention.

The POR circuit 131 illustrated in FIG. 3 includes a resistor 141, a capacitor 142, and a buffer 143 including two inverters connected in series. The high power supply potential VDD is input to one terminal of the resistor 141 and the other terminal thereof is electrically connected to one electrode of the capacitor 142 and to an input portion of the buffer 143. The ground potential is input to the other electrode of the capacitor 142. An output portion of the buffer 143 corresponds to an output terminal OUT of the POR circuit 131.

The above describes a configuration example of the POR circuit 131.

In FIG. 2B, the signal SP/DATA[1] is input to an input terminal of the analog switch 135, and an output terminal of the analog switch 135 is electrically connected to a first electrode of the transistor 137, a clock input terminal of the flip-flop circuit 133, and the output portion of the blocking circuit 103. The ground potential GND is input to a second electrode of the transistor 137. The high power supply potential VDD is input to an input terminal of the POR circuit 131 and the output terminal of the POR circuit 131 is electrically connected to the clear input terminal CLRB of the flip-flop circuit 133. In the flip-flop circuit 133, the high power supply potential VDD is input to the input terminal D; the output terminal Q is electrically connected to a gate of a PMOS of the analog switch 135 and to a gate of the transistor 137; and the inverse output terminal QB is electrically connected to a gate of an NMOS of the analog switch 135.

The operation of the blocking circuit 103 illustrated in FIG. 2B is now described with reference to FIG. 2B, FIG. 3, and FIG. 4. The POR circuit 131 hereinbelow employs the configuration illustrated in FIG. 3.

Figure 4:
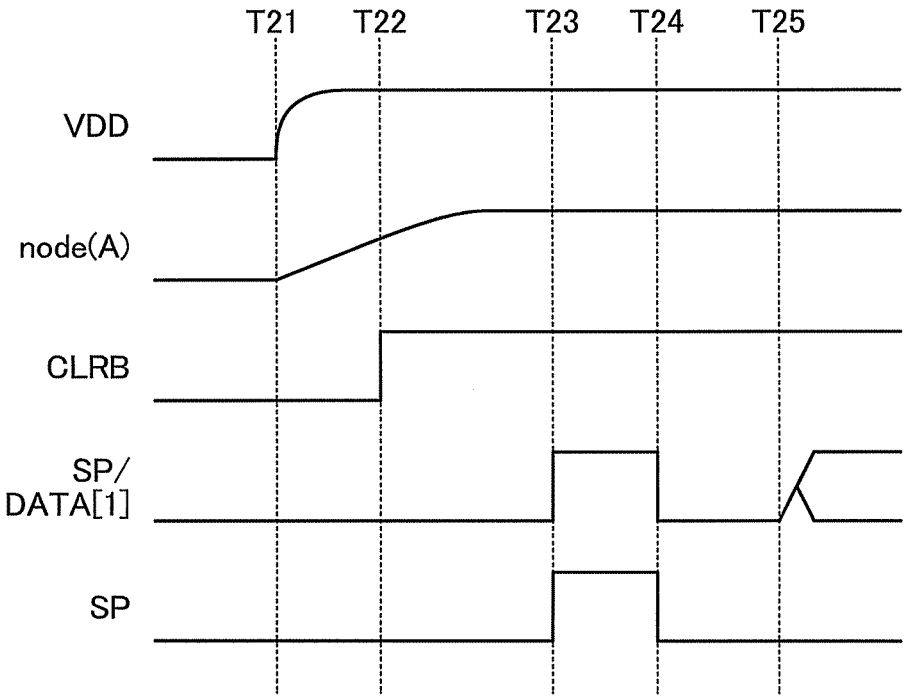
FIG. 4 illustrates a timing chart related to an operation of a blocking circuit in a display device of one embodiment of the present invention.

An example of a timing chart of the operation of the blocking circuit 103 illustrated in FIG. 2B is shown in FIG. 4. FIG. 4 schematically shows changes over time in the high power supply potential VDD and in the potentials of a node A connected to the input portion of the buffer 143 in the POR circuit 131 in FIG. 3, the clear input terminal CLRB of the flip-flop circuit 133, the signal SP/DATA[1], and the start pulse signal SP output from the blocking circuit 103.

The assumption is that the ground potential is applied to all the terminals until the time T21 at which the power supply is on. Thus, since the ground potential is input to the clear input terminal CLRB of the flip-flop circuit 133, the flip-flop circuit 133 is in the inactive state.

When the power supply is on at the time T21, the potential of the high power supply potential VDD rises from the ground potential. Further, under the influence of delay due to the RC component of the POR circuit 131, the potential of the node A begins to increase more gently than the potential of the high power supply potential VDD.

In the period from the time T21 to the time T22, a low-level potential is input to the clear input terminal CLRB of the flip-flop circuit 133, so that a low-level potential is output from the output terminal Q of the flip-flop circuit 133 while a high-level potential is output from the inverse output terminal QB.

At the time T22, when the potential of the node A exceeds the threshold potential of the inverter on the input portion side in the buffer 143, the output potential of the POR circuit 131 is changed from the ground potential to the high power supply potential VDD, and a high-level potential is input to the clear input terminal CLRB of the flip-flop circuit 133. Thus, the flip-flop circuit 133 is changed from the inactive state to the active state.

In the period from the time T22 to the time T23 at which the start pulse signal SP is input, although the high power supply potential VDD is input to the input terminal D of the flip-flop circuit 133, a low-level potential is input to the clock input terminal CLK, so that output from the flip-flop circuit 133 does not change: a low-level potential and a high-level potential are output from the output terminal Q and the inverse output terminal QB, respectively. Consequently, the analog switch 135 is turned on and the transistor 137 is turned off.

Next, at the time T23, when the start pulse signal is input from the signal SP/DATA[1], the start pulse signal SP is output from the blocking circuit 103 through the analog switch 135.

After that, at the time T24, the start pulse signal of the signal SP/DATA[1] which is input to the clock input terminal CLK of the flip-flop circuit 133 is changed from a high-level potential to a low-level potential, so that the output from the flip-flop circuit 133 changes and a high-level potential and a low-level potential are output from the output terminal Q and the inverse output terminal QB, respectively. Consequently, the analog switch 135 is turned off and the transistor 137 is turned on.

Thus, at and after the time T24, a low-level potential is output from the blocking circuit 103 regardless of the potential of the signal SP/DATA[1] input to the blocking circuit 103. For instance, even when an image signal is input at and after the time T25 as illustrated, the output potential of the blocking circuit 103 is maintained at the low level.

The blocking circuit having such a configuration can extract only the start pulse signal SP from the signal SP/DATA to transmit the start pulse signal SP to the timing signal generating circuit 101 and can block input of the image signal DATA, which is included in the signal SP/DATA, to the timing signal generating circuit 101.

Note that the blocking circuit is not limited to the above configuration and can take any of a variety of configurations as long as at least the above function can be achieved.

The foregoing describes the blocking circuit.

In a display device with a blocking circuit having such a configuration, a terminal through which an image signal DATA is input can be omitted because the terminal through which the start pulse signal SP for starting the driving of the timing signal generating circuit 101 is input also serves as the terminal to which the image signal DATA is input. Consequently, a display device with fewer terminals can be achieved.

This embodiment can be combined as appropriate with any of the other embodiments described in this specification.

(Embodiment 2)

In this embodiment, an example of a display device in which a serial signal is used as the image signal to further reduce the number of terminals is described with reference to drawings. Hereinafter, description of the same portions as the above embodiment is omitted or simplified.

[Configuration Example of Display Device]

Figure 5A:
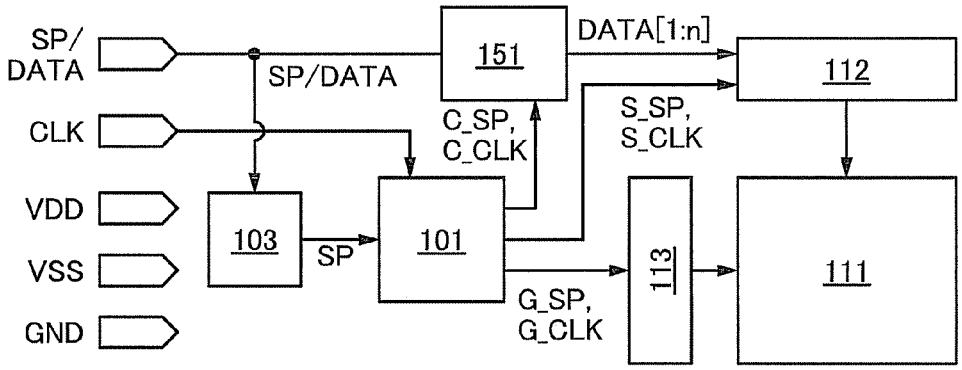
FIGS. 5A and 5B illustrate configuration examples of a display device of one embodiment of the present invention.

A configuration example of a display device exemplified in this embodiment is schematically illustrated in FIG. 5A.

The display device illustrated in FIG. 5A is different from the display device illustrated in FIGS. 1A and 1B exemplified in the above embodiment in having no terminals through which the plurality of image signals DATA[2:n] is input and having a serial-parallel conversion circuit 151.

The serial-parallel conversion circuit 151 converts the input image signal DATA which is a serial signal into the plurality of image signals DATA[1:n] which are parallel signals, and outputs the plurality of image signals DATA[1:n] to the signal line driver circuit 112. Further, the serial-parallel conversion circuit 151 operates on the basis of the start pulse signal C_SP and the clock signal C_SLK which are input from the timing signal generating circuit 101. Hence, the serial-parallel conversion circuit 151 can be driven in synchronization with the signal line driver circuit 112 or the scan line driver circuit 113.

Thus, in the display device with the serial-parallel conversion circuit 151, the number of external input terminals for input of the image signals can be reduced to one. Further, by integration of the start pulse signal SP input to the timing signal generating circuit 101 and the image signal DATA which is a serial signal into one signal SP/DATA, the number of external input terminals can be further reduced.

For example, when three power supply potentials, i.e., a high power supply potential VDD, a low power supply potential VSS, and a ground potential GND, are used as the power supply potential necessary for driving in the display device, the number of external input terminals in the display device can be reduced to five. In this case, the external input terminals in the display device are five external input terminals to which a clock signal CLK, a signal SP/DATA, the high power supply potential VDD, the low power supply potential VSS, and the ground potential GND are input.

In FIG. 5A, the clock signal C_CLK input to the serial-parallel conversion circuit 151 is generated by the timing signal generating circuit 101; however, one clock signal may serve as both the clock signal used for driving of the serial-parallel conversion circuit 151 and the clock signal used for the timing signal generating circuit 101.

Figure 5B:
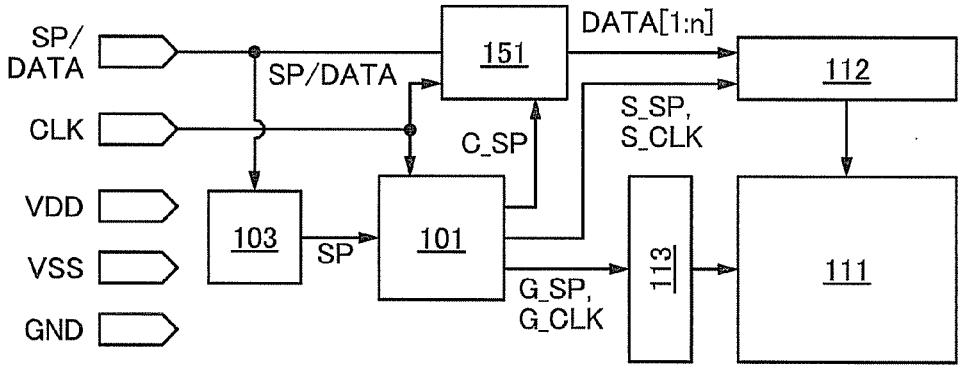

In the configuration illustrated in FIG. 5B, the clock signal CLK is split into two and they are input to the timing signal generating circuit 101 and the serial-parallel conversion circuit 151. Such a configuration is preferred, in which case the kinds of signals generated by the timing signal generating circuit 101 can be reduced and the circuit configuration of the timing signal generating circuit 101 can be simplified.

As described above, a serial signal is used as the image signal input to the display device and one image signal serves as both the image signal and the start pulse signal input to the timing signal generating circuit, whereby the number of terminals in the display device can be extremely reduced.

This embodiment can be combined as appropriate with any of the other embodiments described in this specification.

(Embodiment 3)

In this embodiment, a configuration example of a display device with, fewer terminals is described with reference to drawings. Here, a display device whose pixel includes a light-emitting element is described. Hereinafter, description of the same portions as the above embodiments is omitted or is simplified.

Figure 6A:
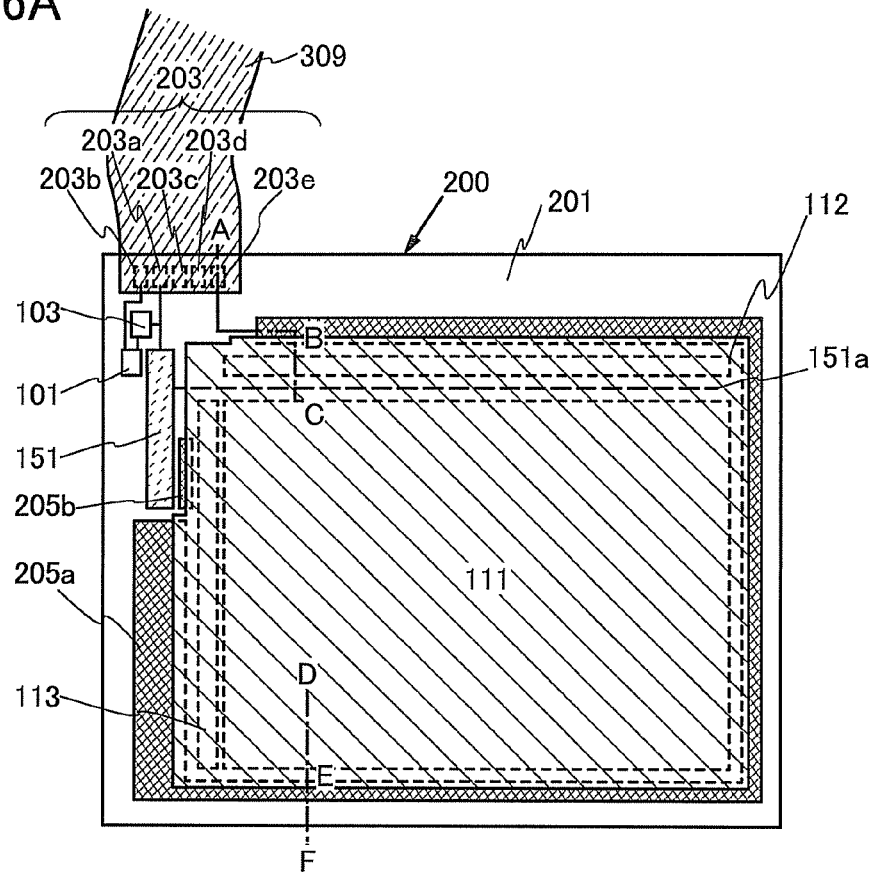
FIGS. 6A and 6B illustrate a configuration example of a display device of one embodiment of the present invention.
Figure 6B:
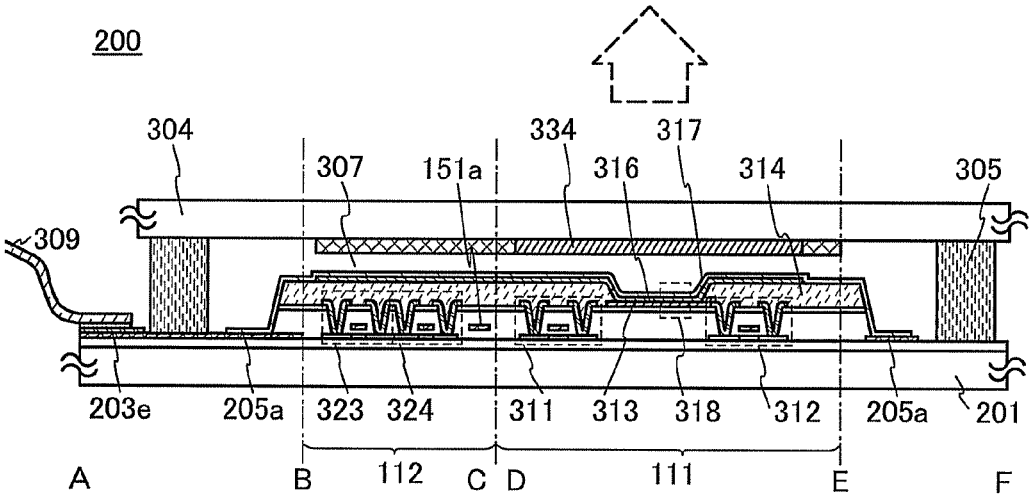

FIG. 6A is a schematic top view of a display device 200 exemplified in this embodiment. FIG. 6B is a schematic cross-sectional view along the cutting plane lines A-B-C and D-E-F in FIG. 6A.

The display device 200 includes the display portion 111 including a plurality of pixels in a matrix, the signal line driver circuit 112 and the scan line driver circuit 113 which are connected to the display portion 111, the serial-parallel conversion circuit 151 which supplies a parallel signal to the signal line driver circuit 112, the timing signal generating circuit 101 which supplies timing signals to at least the signal line driver circuit 112 and the scan line driver circuit 113, and the blocking circuit 103 which supplies a start pulse signal to the timing signal generating circuit 101. Further, the display device 200 also includes a first external input terminal 203*a* through which a signal including a start pulse signal and an image signal that is a serial signal is input to the serial-parallel conversion circuit 151 and the blocking circuit 103, a second external input terminal 203*b* through which a clock signal is input to at least the timing signal generating circuit 101, a third external input terminal 203*c* through which a high power supply potential VDD is input to the display device 200, a fourth external input terminal 203*d* through which a ground potential GND is input to the display device 200, and a fifth external input terminal 203*e* through which a low power supply potential VSS is input to the display device 200.

Here, the first external input terminal 203*a*, the second external input terminal 203*b*, the third external input terminal 203*c*, the fourth external input terminal 203*d*, and the fifth external input terminal 203*e* are collectively referred to as an external input terminal group 203. The external input terminal group 203 is electrically connected to an external connection line 309.

The serial-parallel conversion circuit 151 includes a transistor having a crystalline silicon film over a first substrate 201 over which the display portion 111 is formed. Further, when RC represents an RC load between the first external input terminal 203*a* and the serial-parallel conversion circuit 151, RC satisfies a formula (1).

$$RC < \frac{1}{H \cdot V \cdot fps \cdot \ln(2m)} \tag{1}$$

In the formula (1), H represents the number of sub-pixels in one scan line (also called the number of pixels in the horizontal direction), V represents the number of scan lines (also called the number of pixels in the vertical direction), fps represents a frame rate, and in represents the number of grayscale levels.

Note that in FIG. 6A, part of the structure shown in FIG. 6B is omitted for convenience of description. Specifically, a second substrate 304 provided with a color filter 334 and a sealing material 305 are omitted.

A cross section of the display device 200 is schematically illustrated in FIG. 6B. A cross section of one pixel in the display portion 111 is illustrated. One pixel includes a transistor 311, a transistor 312, and a light-emitting element 318. The light-emitting element 318 includes a first electrode 313, a second electrode 317, and a layer 316 containing a light-emitting organic compound between the electrodes.

One of the first electrode 313 and the second electrode 317 transmits light emitted from the layer 316 containing a light-emitting organic compound. In the light-emitting element 318 exemplified in this embodiment, the second electrode 317 has a light-transmitting property, and light is extracted from the second electrode 317 side.

The first electrode 313, the edge portion of which is covered with a partition wall 314, is electrically connected to a source electrode or a drain electrode of the transistor 312. The second electrode 317, which is extended to the outside of the display portion 111, is electrically connected to a common wire through a common connection portion 205*a* and a common connection portion 205*b*. Note that the common wire is electrically connected to the fifth external input terminal 203*e*.

The signal line driver circuit 112 includes a transistor 323 and a transistor 324.

Transistors included in the pixels of the display portion 111, the signal line driver circuit 112, or the scan line driver circuit 113 and transistors included in the serial-parallel conversion circuit 151, the timing signal generating circuit 101, and the blocking circuit 103 can be integrally formed in the same process. Thus, the number of steps is reduced, so that the display device 200 with high image quality can be easily manufactured.

Alternatively, the transistor included in the pixels of the display portion 111 may be formed in a step which is different from a step of forming the transistors included in the serial-parallel conversion circuit 151, the timing signal generating circuit 101, and the blocking circuit 103. For example, a transistor having an amorphous semiconductor film, a transistor having a polycrystalline semiconductor film, or a transistor having an oxide semiconductor film can be used as the transistor included in the pixels of the display portion 111.

A typical example of an amorphous semiconductor is hydrogenated amorphous silicon. A typical example of a polycrystalline semiconductor is polysilicon (polycrystalline silicon). Examples of polysilicon include so-called high-temperature polysilicon which contains polysilicon as a main component and is formed at a process temperature greater than or equal to 800° C., so-called low-temperature polysilicon which contains polysilicon as a main component and is formed at a process temperature less than or equal to 600° C., polysilicon obtained by crystallizing amorphous silicon by using an element which promotes crystallization or the like, and the like. It is needless to say that a microcrystalline semiconductor or a semiconductor which includes a crystal phase in part of a semiconductor layer can also be used.

Further, an oxide semiconductor may be used. As the oxide semiconductor, for example, any of the following can be used: indium oxide, tin oxide, zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide. Further, any of the above oxide semiconductors may contain an element other than In, Ga, Sn, and Zn, for example, Si.

Here, for example, an In—Ga—Zn-based oxide semiconductor means an oxide semiconductor containing indium (In), gallium (Ga), and zinc (Zn), and there is no limitation on the composition ratio thereof.

The off-state current of a transistor having a channel formation region formed using an oxide semiconductor film can be very small, and the transistor can be used to form a memory element. Specifically, a transistor including an oxide semiconductor film is used as a selection transistor in each pixel of the display portion 111, and a source electrode or a drain electrode of the transistor is connected to a gate electrode of a driving transistor for driving a display element. Since the off-state current of the selection transistor in each pixel is very small, an image signal that is input is stored as a potential of the gate electrode of the driving transistor. Thus, the display portion 111 can have a memory function. Consequently, for example, the display portion 111 can store display data for one frame.

The display device 200 includes the second substrate 304 and the sealing material 305. The light-emitting element 318 in the display portion 111 is sealed in a space 307 enclosed by the first substrate 201, the second substrate 304, and the sealing material 305 surrounding the display portion 111.

On the second substrate 304 exemplified in this embodiment, the color filter 334 is provided to overlap with the pixel of the display portion 111. The light-emitting element 318 which emits white light is provided in the pixel. A color filter that transmits red light is provided in a pixel for red display, a color filter that transmits green light is provided in a pixel for green display, and a color filter that transmits blue light is provided in a pixel for blue display. Thus, a display device capable of full-color display can be provided.

Individual components included in the display device 200 of one embodiment of the present invention will be described below. The display device 200 exemplified in this embodiment is an active-matrix display device; however, one embodiment of the present invention is not limited thereto and is applicable to a passive-matrix display device.

<Display Portion>

The display portion 111 includes a plurality of pixels including a plurality of sub-pixels. The display portion 111 includes. V scan lines are each provided with H sub-pixels. Each pixel includes three sub-pixels (specifically, a pixel R for red display, a pixel G for green display, and a pixel B for blue display) which are not illustrated. Note that each pixel may include four or five sub-pixels in which a pixel W for white display and/or a pixel Y for yellow display are/is included in addition to the above.

The sub-pixels are provided at the intersections of the scan lines and the signal lines and operate in accordance with a selection signal input from the scan line and an image signal input from the signal line. Note that the sub-pixels exemplified in this embodiment each perform an m grayscale display.

The display device 200 displays an image in the display portion 111 at a frame rate fps.

<Serial-Parallel Conversion Circuit>

The display device 200 includes the serial-parallel conversion circuit 151 including the transistor which has the channel formation region formed using the crystalline silicon film with high mobility and operates at high speed. Accordingly, even a serial signal input at high frequency can be converted into a parallel signal. As a result, the display device 200 with high image quality and fewer terminals can be achieved.

Further, a transistor having a channel formation region formed using the crystalline silicon film over the first substrate 201 is used. Accordingly, a wire and a space for bonding can be omitted; and a wire can be further shortened.

Instead of the crystalline silicon film over the first substrate. 201, any of a variety of single crystal semiconductors can be used. With the use of a single crystal semiconductor for a channel formation region of a transistor, the serial-parallel conversion circuit 151 can operate at high speed.

Typical examples of a single crystal semiconductor include semiconductor substrates such as single crystal semiconductor substrates including elements that belong to Group 14, such as a single crystal silicon substrate, a single crystal germanium substrate, and a single crystal silicon germanium substrate; and compound semiconductor substrates (such as an SiC substrate, a sapphire substrate, and a GaN substrate). Preferred one is a silicon on insulator (SOI) substrate in which a single crystal semiconductor layer is provided on an insulating surface.

As a method for forming the SOI substrate, any of the following methods can be used: a method in which oxygen ions are implanted into a mirror-polished wafer and then heating is performed at a high temperature, whereby an oxide layer is formed at a certain depth from a surface of the wafer and a defect caused in the surface layer is eliminated; a method in which a semiconductor substrate is separated by utilizing the growth of microvoids, which are formed by hydrogen ion irradiation, by heat treatment; a method in which a, single crystal semiconductor layer is formed on an insulating surface by crystal growth; and the like.

In this embodiment, ions are added through one surface of a single crystal semiconductor substrate, and an embrittlement layer is formed at a certain depth from the surface of the single crystal semiconductor substrate. Then, an insulating layer is formed over the surface of the single crystal semiconductor substrate or over the first substrate 201. Next, heat treatment is performed in the state in which the single crystal semiconductor substrate provided with the embrittlement layer and the first substrate 201 are bonded to each other with the insulating layer interposed therebetween, so that a crack is generated in the embrittlement layer to separate the single crystal semiconductor substrate along the embrittlement layer. Thus, a single crystal semiconductor layer, which is separated from the single crystal semiconductor substrate, is formed as a semiconductor layer over the first substrate 201. Note that a glass substrate can be used as the first substrate 201.

Regions electrically insulated from each other may be formed in a single crystal semiconductor substrate so that the electrically insulated semiconductor regions form the transistors included in the serial-parallel conversion circuit.

Transistors included in the display portion 111, the signal line driver circuit 112, the scan line driver circuit 113, the timing signal generating circuit 101, and the blocking circuit 103 and transistors included in the serial-parallel conversion circuit 151 can be integrally formed in the same process. Thus, the number of steps is reduced, so that the display device 200 with high image quality can be easily manufactured.

The transistor having a channel formation region formed using a single crystal semiconductor is suitably used in a pixel of the display portion 111 together with the light-emitting element 318. This is because variation in electric characteristics such as threshold voltage of the transistor, which is caused by bonding defects at grain boundaries, can be reduced. Accordingly, in the display device 200, the light-emitting element 318 can normally operate even if a circuit for compensating threshold voltage is not provided in each pixel. The number of circuit elements per pixel can therefore be reduced, increasing the flexibility in layout. Thus, a high-resolution light-emitting device can be achieved. For example, a display device having a matrix of a plurality of pixels, specifically 350 pixels or more per inch (i.e., the horizontal resolution is 350 pixels per inch (ppi) or more), more preferably 400 or more pixels per one inch (i.e., the horizontal resolution is 400 ppi or more) can be achieved.

Moreover, a transistor having a channel formation region formed using a single crystal semiconductor can be downsized while keeping high current drive capability. The use of the downsized transistor leads to a reduction in the area of a circuit portion that does not contribute to display operation, resulting in an increase in the area of a region of the display portion 111 where an image is displayed and a reduction in the frame size of the display device 200.

The signal line driver circuit 112 is provided along a row of the display portion 111, and the scan line driver circuit 113 is provided along a column of the display portion 111. The serial-parallel conversion circuit 151 is provided in a corner portion where the signal line driver circuit 112 and the scan line driver circuit 113 are close to each other; and the serial-parallel conversion circuit 151 is provided more apart from the display portion 111 (closer to the outer edge portion of the first substrate 201) than the scan line driver circuit 113 is. A signal line 151*a*, through which a parallel signal is supplied from the serial-parallel conversion circuit 151 to the signal line driver circuit 112, is provided between the display portion 111 and the signal line driver circuit 112, along the rows of the display portion 111.

In the display device 200, the serial-parallel conversion circuit 151 is provided close to the signal line driver circuit 112. Further, the signal line 151*a*, through which the parallel signal is supplied from the serial-parallel conversion circuit 151 to the signal line driver circuit 112, is provided along the rows of the display portion 111. Accordingly, a wire for connecting the serial-parallel conversion circuit 151 to the signal line driver circuit 112 can be shortened as compared to other arrangement, whereby delay of a signal can be made less likely to occur. As a result, a display device with high image quality can be provided.

<RC Load RC>

An RC load RC between the first external input terminal 203*a* and the serial-parallel conversion circuit 151 in the display device 200 exemplified in this embodiment is described.

It is necessary that settling time tset of the serial-parallel conversion circuit 151 be shorter than allowable time tsamp for transferring a signal to one sub-pixel.

Figure 7:
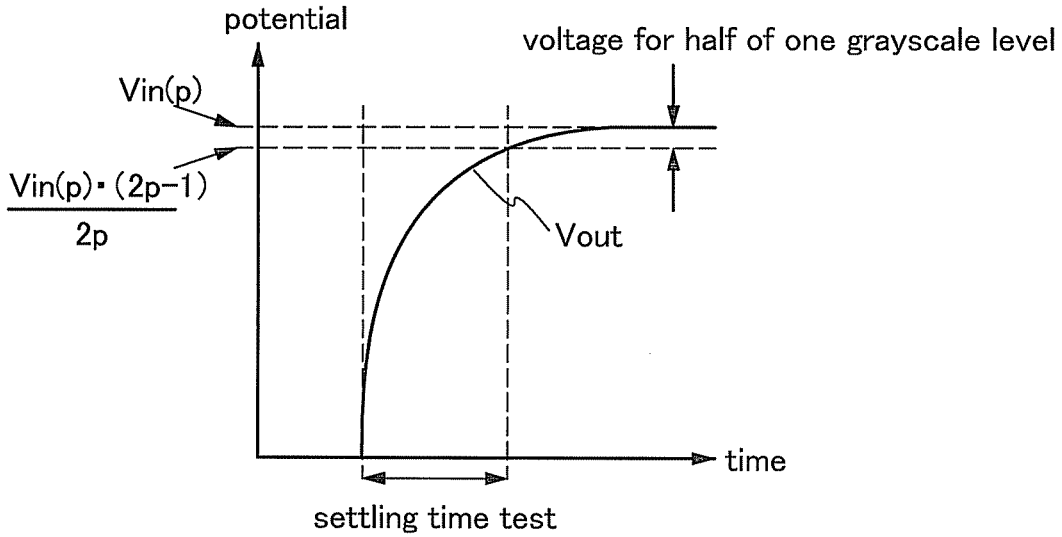
FIG. 7 illustrates signal delay in a display device of one embodiment of the present invention.

In the case where the RC load RC is present between the first external input terminal 203*a* and the serial-parallel conversion circuit 151, a voltage Vin of a signal input to the first external input terminal 203*a* is input to the serial-parallel conversion circuit 151 with delay (see FIG. 7). A voltage Vout input to the serial-parallel conversion circuit 151 with delay is expressed by the following formula (2).

$$\frac{Vout}{Vin} = \left(1 - \exp\left(-\frac{t}{RC}\right)\right) \tag{2}$$

Here, when the pth (p is greater than or equal to 1 and less than or equal to in) grayscale display is performed, the settling time tset of the serial-parallel conversion circuit 151 is defined as the time taken for the voltage Vout, which is the voltage of the signal input to the serial-parallel conversion circuit 151 with delay, to reach the value lower than the voltage Vin(p), which is the voltage of the signal input to the first external input terminal 203*a*, by a voltage for a half of one grayscale level (see FIG. 7). The settling time tset can be expressed by the following formula (3).

$$tset = -RC \cdot \ln\left(1 - \frac{Vin(p) \cdot ((2p-1)/2p)}{Vin(p)}\right) = RC \cdot \ln(2p) \tag{3}$$

The allowable time tsamp for transferring one analog signal to one sub-pixel is expressed by the following formula (4).

$$tsamp = \frac{1}{H \cdot V \cdot fps} \tag{4}$$

It is necessary that the settling time tset be shorter than the allowable time tsamp for transferring the signal to one sub-pixel. Further, the settling time tset is longer as the value of the voltage Vin of the signal input to the first external input terminal 203*a* is larger; the settling time tset is the maximum at the mth grayscale display is performed. Hence, in the display device 200, the RC load RC between the first external input terminal 203*a* and the serial-parallel conversion circuit 151 satisfies the following formula (1).

$$RC < \frac{1}{H \cdot V \cdot fps \cdot \ln(2m)} \tag{1}$$

In the formula (1), H represents the number of sub-pixels in one scan line (also called the number of pixels in the horizontal direction), V represents the number of scan lines (also called the number of pixels in the vertical direction), fps represents a frame rate, and in represents the number of grayscale levels.

<Timing Signal Generating Circuit and Blocking Circuit>

The timing signal generating circuit 101 includes a transistor having crystalline silicon film over the first substrate 201. On the basis of the clock signal input to the second external input terminal 203*b* and the start pulse signal input from the blocking circuit 103, the timing signal generating circuit 101 outputs the timing signals to the signal line driver circuit 112, the scan line driver circuit 113, and the serial-parallel conversion circuit 151.

In the display device 200, the timing signal generating circuit 101 includes the transistor, which has a channel formation region formed using the crystalline silicon film with high mobility and thus operates at high speed, and can generate two or more timing signals from the clock signal supplied through the second external input terminal 203*b*. Hence, the display device 200 can be driven using the two or more timing signals without an external connection terminal for a timing signal. As a result, the display device 200 with high image quality and fewer terminals can be provided The blocking circuit 103 includes a transistor having a crystalline silicon film over the first substrate 201. The blocking circuit 103 extracts only the start pulse signal from the signal input to the first external input terminal 203*a*, and outputs the signal to the timing signal generating circuit 101.

The blocking circuit 103 is provided close to the first external input terminal 203*a*, through which a signal including a start pulse signal and an image signal that is a serial signal is supplied, adjacent to the timing signal generating circuit 101, and more apart from the display portion 111 than the serial-parallel conversion circuit 151 is. The timing signal generating circuit 101 is provided close to the second external input terminal 203*b*, which supplies a clock signal, adjacent to the serial-parallel conversion circuit 151, and more apart from the display portion 111 than the serial-parallel conversion circuit 151 is. Hence, the length of a wire for connecting the second external input terminal 203*b* and the blocking circuit 103 and a wire for connecting the blocking circuit 103 and the timing signal generating circuit 101 can be shorter than those in other arrangement, whereby signal delay can be made less likely to occur. As a result, a display device with high image quality and fewer terminals can be provided.

<Light-Emitting Element>

The light-emitting element 318 is provided in the sub-pixel of the display device 200 exemplified in this embodiment. The light-emitting element 318 which is applicable to the display device 200 includes the first electrode 313; the second electrode 317, and the layer 316 containing a light-emitting organic compound between the electrodes. One of the first electrode 313 and the second electrode 317 is an anode, and the other thereof is a cathode. When a voltage higher than the threshold voltage of the light-emitting element 318 is applied between the first electrode 313 and the second electrode 317, holes are injected from the anode and electrons are injected from the cathode to the layer 316 containing a light-emitting organic compound. The injected holes and electrons are recombined, whereby the light-emitting organic compound emits light.

Here, a layer or a stacked body which includes one region where electrons and holes are recombined is referred to as a light-emitting unit. In the layer containing a light-emitting organic compound, at least one light-emitting unit can be included, and two or more light-emitting units may overlap with each other. For example, two light-emitting units are formed so that the color of light emitted from one of the two light-emitting units is complementary to the color of light emitted from the other of the two light-emitting units; thus, a light-emitting element that emits white light can be formed.

<Common Connection Portion>

The display device 200 includes a plurality of pixels in the display portion 111. Each of the pixels includes the light-emitting element 318.

The first electrode 313 is provided over the first substrate 201 and supplied with power through the transistor 312. Note that the pixels in the display portion 111 have similar structures.

The second electrode 317 is extended to the outside of the display portion 111 and supplied with power through the common connection portions 205*a* and 205*b*. Here, the common connection portions 205*a* and 205*b* are provided so as to surround the display portion 111. Accordingly, a voltage drop due to a resistance component of the second electrode 317 can be suppressed in the entire display portion 111, whereby display unevenness can be reduced. As a result, a self-luminous display device with high image quality and fewer terminals can be achieved. Note that the common connection portions 205*a* and 205*b* are electrically connected to each other through a conductive layer which overlaps with the common connection portions 205*a* and 205*b* but is not shown.

In particular, in the case where the common connection portion 205*a* having a larger width than the serial-parallel conversion circuit 151 is provided on the serial-parallel conversion circuit 151 side of the display portion 111, the common connection portion 205*a* and the second electrode 317 are in contact with each other in a large area and electrical connection therebetween can be ensured. Further, the use of the common connection portion 205*a* having a larger width enables wire resistance to be reduced.

The foregoing describes the display device 200 exemplified in this embodiment.

With such a configuration, a serial signal is used as the image signal input to the display device and one image signal serves as both the image signal and the start pulse signal input to the timing signal generating circuit, whereby the number of terminals in the display device can be extremely reduced.

This embodiment can be combined as appropriate with any of the other embodiments described in this specification.

(Embodiment 4)

In this embodiment, examples of an electronic device to which a display device of one embodiment of the present invention is applied will be described with reference to FIGS. 8A to 8C.

Examples of the electronic device to which the display device is applied include television sets (also referred to as televisions or television receivers), monitors of computers or the like, digital cameras, digital video cameras, digital photo frames, cellular telephones (also referred to as cellular phones or cellular phone devices), portable game consoles, personal digital assistants, audio reproducing devices, and large-sized game machines such as pachinko machines.

Figure 8A:
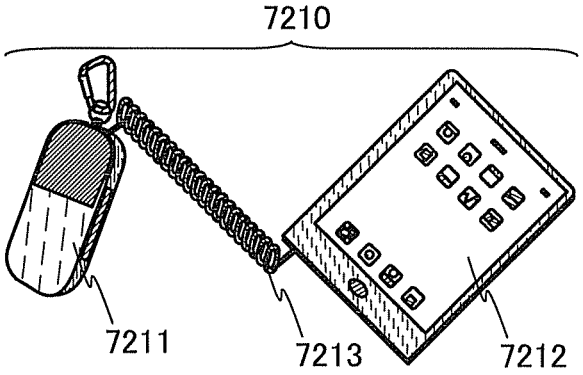
FIGS. 8A to 8C illustrate configuration examples of electronic devices of one embodiment of the present invention.

FIG. 8A illustrates an example of a personal digital assistant. In a personal digital assistant 7210, a main body 7211 and a display device 7212 are connected to each other by a cable 7213. The cable 7213 transmits serial data including image data from the main body 7211 to the display device 7212 and transmits operation performed on the display device 7212 to the main body 7211. Further, the cable 7213 also has a function of preventing the display device from being damaged by being dropped.

Figure 8B:
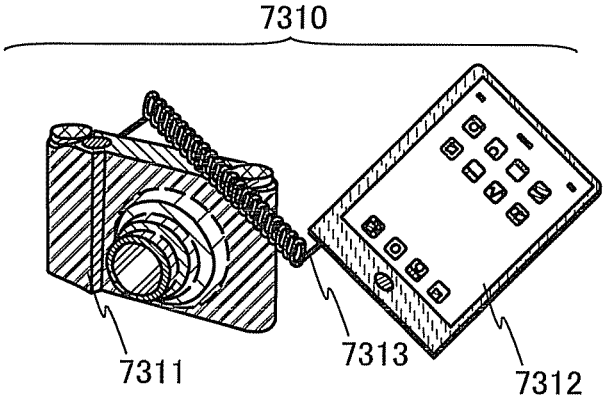

FIG. 8B illustrates an example of a digital camera. In a digital camera 7310, a main body 7311 and a display device 7312 are connected to each other by a cable 7313. The cable 7313 transmits serial data including image data from the main body 7311 to the display device 7312 and transmits operation performed on the display device 7312 to the main body 7311.

Figure 8C:
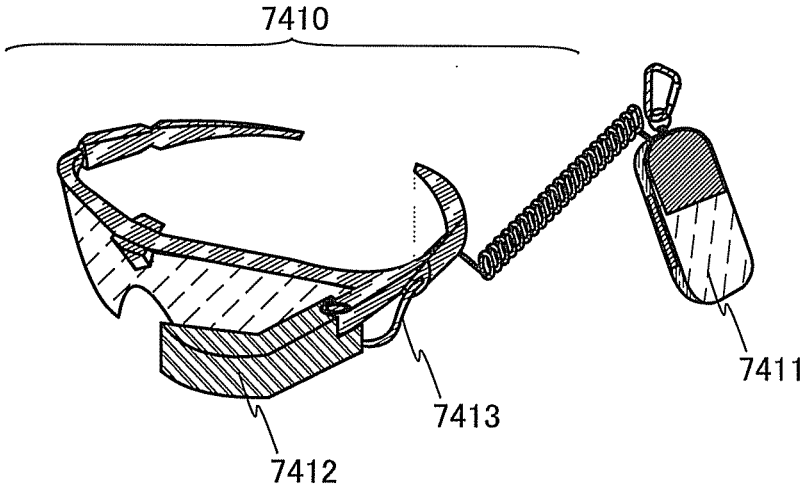

FIG. 8C illustrates an example of a head-mounted display. In a head-mounted display 7410, a main body 7411 and a display device 7412 are connected to each other by a cable 7413. The cable 7413 transmits serial data including image data from the main body 7411 to the display device 7412 set in a housing. Further, the movement of eyeball and eyelid of a user can be captured by a camera in the housing, and data on the movement can be transmitted to the main body 7411. From the data on the movement of the eyeball and the eyelid, coordinates of the points the user looks at are calculated in the main body 7411. Thus, the user can use the points for a pointing device.

In the display device of one embodiment of the present invention, the number of terminals is reduced, which leads to reduction in the number of wires in a cable to be connected to an external device. In addition, the cable is bent with flexibility and the weight thereof is reduced. As a result, display can be seen with only a lightweight display portion held in a hand, for example, while a main body is put in a pocket or a bag. Further, the main body can be operated with the use of the display portion.

This embodiment can be combined as appropriate with any of the other embodiments described in this specification.

This application is based on Japanese Patent Application serial no. 2012-028058 filed with the Japan Patent Office on Feb. 13, 2012, the entire contents of which are hereby incorporated by reference.

What is claimed is:

1. A display device comprising:

a display portion comprising a plurality of pixels;

a scan line driver circuit electrically connected to the display portion;

a signal line driver circuit electrically connected to the display portion;

a first circuit electrically connected to the scan line driver circuit and the signal line driver circuit;

a second circuit electrically connected to the first circuit; and a first terminal to which a signal into which an image signal and a start pulse signal are integrated is input, wherein the signal is input to the signal line driver circuit and the second circuit from the first terminal, wherein the second circuit is configured to output the start pulse signal extracted from the signal to the first circuit, and wherein the signal is input to the signal line driver circuit.

2. The display device according to claim 1, further comprising a first switch and a second switch in the second circuit, wherein the first switch comprises a second terminal electrically connected to the first terminal and a third terminal electrically connected to the first circuit, wherein the second switch comprises a fourth terminal to which a ground potential is input and a fifth terminal electrically connected to the first circuit, and wherein the first switch and the second switch are configured to turn off and turn on, respectively, by input of the start pulse signal.

3. The display device according to claim 1, further comprising:

a sixth terminal to which a first power supply potential is input;

a seventh terminal to which a second power supply potential lower than the first power supply potential is input; and an eighth terminal to which a ground potential is input, wherein each of the pixels comprises a light-emitting element comprising a first electrode, a second electrode, and a layer comprising a light-emitting organic compound between the first electrode and the second electrode, wherein the first electrode is supplied with a potential lower than the first power supply potential and higher than the second power supply potential in accordance with the image signal, and wherein the second electrode is supplied with the first power supply potential or the second power supply potential.

4. A display device comprising:

a display portion comprising a plurality of pixels;

a scan line driver circuit electrically connected to the display portion;

a signal line driver circuit electrically connected to the display portion;

a timing signal generating circuit configured to output a timing signal to each of the scan line driver circuit and the signal line driver circuit;

a first external input terminal to which a signal into which an image signal and a start pulse signal are integrated is input;

a second external input terminal to which a clock signal is input; and a blocking circuit configured to extract the start pulse signal from the signal and output the start pulse signal to the timing signal generating circuit, wherein the signal is input to the signal line driver circuit and the blocking circuit from the first external input terminal, wherein the clock signal is input to the timing signal generating circuit from the second external input terminal, and wherein the start pulse signal is configured to drive the timing signal generating circuit.

5. The display device according to claim 4, further comprising a first switch and a second switch in the blocking circuit, wherein the first switch comprises a first terminal electrically connected to the first external input terminal and a second terminal electrically connected to the timing signal generating circuit, wherein the second switch comprises a third terminal to which a ground potential is input and a fourth terminal electrically connected to the timing signal generating circuit, and wherein the first switch and the second switch are configured, to turn off and turn on, respectively, by input of the start pulse signal.

6. The display device according to claim 4, further comprising:

a third external input terminal to which a first power supply potential is input;

a fourth external input terminal to which a second power supply potential lower than the first power supply potential is input; and a fifth external input terminal to which a ground potential is input, wherein each of the pixels comprises a light-emitting element comprising a first electrode, a second electrode, and a layer comprising a light-emitting organic compound between the first electrode and the second electrode, wherein the first electrode is supplied with a potential lower than the first power supply potential and higher than the second power supply potential in accordance with the image signal, and wherein the second electrode is supplied with the first power supply potential or the second power supply potential.

7. A display device comprising:

a display portion comprising a plurality of pixels;

a scan line driver circuit electrically connected to the display portion;

a signal line driver circuit electrically connected to the display portion;

a serial-parallel conversion circuit;

a timing signal generating circuit configured to output a timing signal to each of the scan line driver circuit, the signal line driver circuit, and the serial-parallel conversion circuit;

a first external input terminal to which a signal into which a first image signal and a start pulse signal are integrated is input;

a second external input terminal to which a clock signal is input; and a blocking circuit configured to extract the start pulse signal from the signal to the timing signal generating circuit, wherein the signal is input to the serial-parallel conversion circuit and the blocking circuit from the first external input terminal, wherein the clock signal is input to the timing signal generation circuit from the second external input terminal, wherein the serial-parallel conversion circuit is configured to convert the first image signal that is a serial signal into a second image signal that is a parallel signal and output the second image signal to the signal line driver circuit, and wherein the start pulse signal is configured to drive the timing signal generating circuit.

8. The display device according to claim 7, further comprising a first switch and a second switch in the blocking circuit, wherein the first switch comprises a first terminal electrically connected to the first external input terminal and a second terminal electrically connected to the timing signal generating circuit, wherein the second switch comprises a third terminal to which a ground potential is input and a fourth terminal electrically connected to the timing signal generating circuit, and wherein the first switch and the second switch are configured to turn off and turn on, respectively, by input of the start pulse signal.

9. The display device according to claim 7, further comprising:

a third external input terminal to which a first power supply potential is input;

a fourth external input terminal to which a second power supply potential lower than the first power supply potential is input; and a fifth external input terminal to which a ground potential is input, wherein each of the pixels comprises a light-emitting element comprising a first electrode, a second electrode, and a layer comprising a light-emitting organic compound between the first electrode and the second electrode, wherein the first electrode is configured to be supplied with a potential lower than the first power supply potential and higher than the second power supply potential in accordance with the second image signal, and wherein the second electrode is configured to be supplied with the first power supply potential or the second power supply potential.

* * * * *

UNITED STATES PATENT AND TRADEMARK OFFICE

CERTIFICATE OF CORRECTION

PATENT NO. : 9,230,502 B2
APPLICATION NO. : 13/761461
DATED : January 5, 2016
INVENTOR(S) : Kazunori Watanabe It is certified that error appears in the above-identified patent and that said Letters Patent is hereby corrected as shown below:

In the Specification:

Column 3, Line 53; Change “printed, circuit” to --printed circuit--.

Column 10, Line 46; Change “with, fewer” to --with fewer--.

Column 11, Line 33; Change “and in represents” to --and m represents--.

Column 13, Line 24; Change “includes. V” to --includes V--.

Column 13, Line 49; Change “omitted; and” to --omitted, and--.

Column 13, Lines 50 to 51; Change “substrate. 201,” to --substrate 201,--.

Column 14, Line 7; Change “a, single” to --a single--.

Column 15, Line 43; Change “to in) grayscale” to --to m) grayscale--.

Column 16, Line 17; Change “and in represents” to --and m represents--.

Column 16, Line 21; Change “having crystalline” to --having a crystalline--.

Column 16, Line 64; Change “electrode 313; the” to --electrode 313, the--.

In the Claims:

Column 20, Lines 1 to 2, Claim 5; Change “configured, to” to --configured to--.

Column 20, Line 43, Claim 7; Change “the signal to the” to
--the signal and output the start pulse to the--.

Column 20, Lines 48 to 49, Claim 7; Change “signal generation circuit” to
--signal generating circuit--.

Signed and Sealed this
Thirty-first Day of May, 2016

Michelle K. Lee

Michelle K. Lee
*Director of the United States Patent and Trademark Office*